United States Patent [19]

Read

[11] 4,371,046

[45] Feb. 1, 1983

[54] APPARATUS FOR AND METHOD OF DRILLING A HOLE INTO THE GROUND

[76] Inventor: Vernon Read, 550 N St., SW., Washington, D.C. 20024

[21] Appl. No.: 141,977

[22] Filed: Apr. 21, 1980

[51] Int. Cl.[3] ..... E21B 7/02

[52] U.S. Cl. ..... 175/57; 52/116; 173/28; 173/147

[58] Field of Search ..... 175/57, 85; 173/28, 173/46, 147, 45; 52/116, 117

[56] References Cited

U.S. PATENT DOCUMENTS

| | | | |
|---|---|---|---|
| 2,168,837 | 8/1939 | York . | |
| 2,176,731 | 10/1939 | Claire | 52/117 |
| 2,200,075 | 5/1940 | Caldwell | 173/28 |
| 2,271,577 | 2/1942 | Woolslayer et al. | 52/117 |
| 2,336,437 | 12/1943 | Wilson | 52/118 |
| 2,573,528 | 10/1951 | Woolslayer et al. | 52/117 |
| 2,617,500 | 11/1952 | Cardwell et al. | 52/118 |
| 2,703,634 | 3/1955 | Lee | 52/117 |
| 2,808,911 | 10/1957 | McLerran | 52/119 |
| 2,847,098 | 8/1958 | Heinish | 52/118 |
| 3,009,546 | 11/1961 | Anderson et al. | 52/117 |
| 3,109,523 | 11/1963 | Moller | 52/117 |
| 3,295,270 | 1/1967 | Woolslayer et al. | 52/117 |
| 3,527,309 | 9/1970 | Rassieur | 173/28 |
| 3,888,318 | 6/1975 | Brown | 52/116 |
| 3,994,350 | 11/1976 | Smith | 173/47 |
| 4,126,193 | 11/1978 | Brown | 173/28 |

OTHER PUBLICATIONS

Figures A, B and C illustrating Prior Art Oil Rig used by Western Core Drilling Co.

*Primary Examiner*—William F. Pate, III

*Attorney, Agent, or Firm*—Lowe, King, Price & Becker

[57] ABSTRACT

A drilling rig carried by a vehicle includes a mast having upper and lower sections. The lower section is mounted on a support surface of the vehicle which is maintained parallel to the ground surface during drilling. The upper section is secured to the lower section so that the longitudinal axes of the upper and lower sections are offset at a predetermined acute angle and the top of the upper section is beyond an edge of the surface. A rotary power drill head is translatable along the length of the lower section. A cable pulled by a draw works on the vehicle extends over a pulley at the top of the upper section and thence downwardly. The angle of the surface is controlled so that during vertical hole drilling the surface is horizontal and the power drill head is directly above the hole. During pipe hoisting, the pulley is directly above the hole so the cable extends downwardly in line with the hole, while it is attached to the pipe. During drilling, the cable extends over a sheave, at the intersection of the two sections, and is connected to the drill head, to assist in supporting it. Adjustable length support arms extend from the top of the upper section to bear against the ground, outside opposite sides of the mast. The support arms and a pair of outrigger supports for the surface of the vehicle intersect a common straight line on the ground. A retractable, hydraulically actuated strut connects the upper and lower sections together, to raise and lower the upper section relative to the lower section and fold the upper section on top of the lower section, during transport.

13 Claims, 5 Drawing Figures

APPARATUS FOR AND METHOD OF DRILLING A HOLE INTO THE GROUND

TECHNICAL FIELD

The present invention relates generally to apparatus for and method of drilling holes into the ground, and more particularly to such a method and apparatus including a mast having upper and lower sections having offset longitudinal axes.

BACKGROUND ART

Mobile rigs for drilling holes into the ground frequently employ a mast mounted on a support surface that is normally disposed parallel to the ground surface. A rotary power drill head for a drill pipe is mounted on the mast, and driven by a suitable source, such as a hydraulic power source. The rotary power drill head, in one configuration, is translatable along the mast, in the vertical direction, on a pair of chains extending vertically along the mast. During drilling, the power drill head is driven downwardly close to the ground surface; during drill pipe hoisting, the power drill head is raised, toward the top of the mast.

Drilling rigs of this nature have been employed to drill multiple holes into the ground at diverse sites. When it is desired to move the rig from one position to another, the mast is folded onto the vehicle and the vehicle is driven between sites.

Generally, such rigs have been employed in the past to drill blast holes and water wells. As such, depths have been generally restricted to 200 to 300 feet by employing no more than fifteen 20 to 25 foot long drill pipes, which when interconnected form a drill string. Attempts to use the prior art mobile rigs for deeper drilling generally fail because the weight of the drill pipe exceeds the load limit of the chains which support the rotary power drill head and the rotary power drill head cannot drive the drill pipe at sufficiently high speed. Also, it has frequently been necessary, in utilizing the mobile drilling rigs, to lay single lengths of pipe horizontally on the ground and to insert the single lengths of pipe into the rotary drill head. Such procedures are obviously time consuming, and therefore expensive.

While it has been the practice in oil field drilling to provide relatively immobile structures with extendable masts with a pipe racking platform, these practices have not been used for other terrain where the ground is harder than the sedimentary formations, where oil is usually located. Oil field equipment does not generally function adequately in hard, metamorphic volcanic rocks, as exist in hard rock mining areas, and in desert arid areas. In hard rock mining areas and arid desert areas there is a need, however, to drill relatively deep holes, such as 4,000 to 5,000 feet to obtain water. In addition, geothermal wells are frequently drilled to such a depth in hard rock mining and desert areas. It is also frequently desirable to drill deep holes in such areas for mineral exploration purposes. Oil well drilling also differs from hard rock drilling because in oil well drilling the drill pipe is turned by a rotary table that is fixedly mounted on the ground, and is not a part of the vehicle, as in the case of a power rotary drill head.

It is, therefore, an object of the present invention to provide a new and improved method of and apparatus for drilling relatively deep holes in various types of relatively hard substrata, for mining, blast hole, and quarry and/or water drilling purposes.

Another object of the invention is to provide a new and improved apparatus for and method of driving many lengths of drill pipe into the ground, and for hoisting sections of the drill pipe.

DISCLOSURE OF THE INVENTION

In accordance with the present invention, a new and improved apparatus for and method of drilling into the earth includes a mast having a lower section that is mounted on a support surface and an upper section having a longitudinal axis offset from the longitudinal axis of the lower section. A top portion of the upper section extends beyond an edge of the support surface for the ower mast section. A vehicle for carrying the mast includes a rotary power drill head that is translatable along the length of the lower section, as in some currently available drilling rigs. As in the currently available drilling rigs, the drill head is translatable by a pair of vertically extending chains on opposite sides of the mast. The chains extend along the length of only the lower mast section. As in some of the currently available rigs, a draw works is included on the vehicle. The draw works includes cable means that extends over a pulley means, preferably a crown block, in proximity to the top portion of the upper section.

In a preferred embodiment, the cable means comprises a cable that extends from the draw works to the crown block and multiple wires that extend from the crown block to a travelling block which hangs below the crown block. The cable means further comprises a cable which extends from a weight that is connected to the travelling block; the cable is connected between the weight and a support structure for the rotary power drill head and is paid across a sheave at the intersection of the two mast sections. By utilizing the chain and the draw works, it is possible to markedly increase the weight which can be supported by the rotary power drill head, and thereby considerably increase the depth to which holes can be drilled into hard substrata, relative to the prior art which employed rotary power drill heads. To assist in forming relatively long drill strings by racking a number of drill pipes together and to assist in controlling the depth of a drill rod string, during drilling, brake and clutch controls are provided for the draw works.

During drilling of vertical holes, the support surface for the lower mast section is maintained parallel to the ground surface. During hoisting, after a vertical hole has been drilled, the support surface is tilted so the axis of the cable means as it is paid around the pulley means at the top portion of the upper mast section is aligned with the hole. To this end, the cable means is released from the sheave during the hoisting operation and the drill rod is removed from the rotary drill head. Thereby, the cable means can extend downwardly and be in alignment with the drill pipe string. To remove the drill string, the draw works applies tension to the cable and hence the drill rod or pipe so the rod and drill string are removed from the hole.

The invention can be used to drill holes that are inclined from the vertical by tilting the lower section relative to the support surface therefor. The hole is drilled and the rod string hoisted while the drill rod is maintained perpendicular to the hole.

A further feature of the invention, which provides increased stability for the two section mast, includes first and second rigid, adjustable length support legs that extend from adjacent the top of the upper section. The adjustable length support legs, preferably telescoping, have feet in close proximity to the rig and which bear against the ground on opposite sides of the mast. To provide the increased stability, the support legs intersect the ground outside of outrigger supports which lift the vehicle off of the ground and control the tilt angle of the support surface. Preferably, the outrigger supports and adjustable length support legs intersect the ground along a common straight line, to stabilize the vehicle and support surface.

Structural support for the mast structure is also provided by guy wires that extend from the vehicle to the top of the mast. The guy wires are, in effect, prestressed cables that extend over guides at the intersection between the two mast sections and are positioned on the opposite side of the mast structure from the power drill head. By employing a pair of guy wires, as stated, in combination with the rigid, adjustable length support arms, it is not necessary to employ external guy wires, i.e., guy wires which extend from the mast structure to points on the ground remote from the rig.

A further feature of the invention is that the mast can be jackknifed so that the lower section lies on the vehicle during travel, and the upper section is folded onto the lower section. For convenience, during the erection process, the upper section is connected to the lower section by a retractable strut that maintains a predetermined angle between the two sections during drilling and hoisting.

The above and still further objects, features and advantages of the present invention will become apparent upon consideration of the following detailed description of one specific embodiment thereof, especially when taken in conjunction with the accompanying drawings.

BEST MODE FOR CARRYING OUT THE INVENTION

Figure 1:
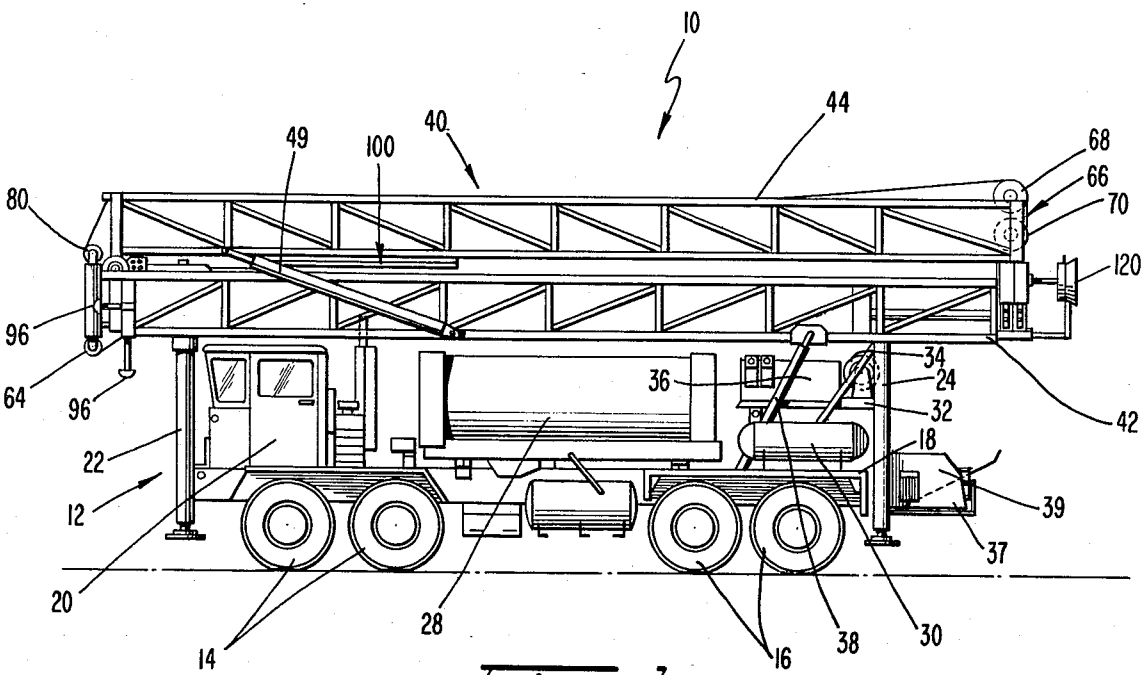
FIG. 1 is a side view of a vehicle including a mast structure in accordance with the present invention, with the mast structure in a folded position.

Reference is now made to FIG. 1 of the drawing wherein there is illustrated a mobile drilling rig 10 constructed in accordance with a preferred embodiment of the invention. Mobile rig 10 includes a self-propelled carrier or truck 12 of a conventional type, with tandem, dual front wheels 14 and tandem, dual rear wheels 16, as well as a support surface 18 which lies in a plane parallel to the plane over which vehicle 12 is traversing or on which vehicle 12 is resting. On the front of cab 20 of vehicle 12 is a centrally located hydraulically actuated jack 22; at the rear of vehicle 12 is a pair of hydraulically activated outrigger jacks 24 and 26 which are approximately aligned with a plane between individual wheels of tandem rear wheels 16.

Fixedly mounted on support surface 18 is a drive and compressor unit 28 and hydraulic reservoir tank 30, as well as platform 32 which carries single drum draw works 34. Draw works 34 is driven by power take-off from the truck engine and controlled by a hydraulic drill feed and drilling weight control motor 36, in turn responsive to power generated from drive and compressor unit 28. To control the cables paid around draw works 34, so that the cables can be held in a braked position, as well as to control movement of the cables, a draw works brake and clutch controller 35 is mounted on platform 37 which extends from the rear of vehicle 12. Controller 35 is connected between draw works drive motor 36 and draw works 34 in a conventional manner.

Figure 2:
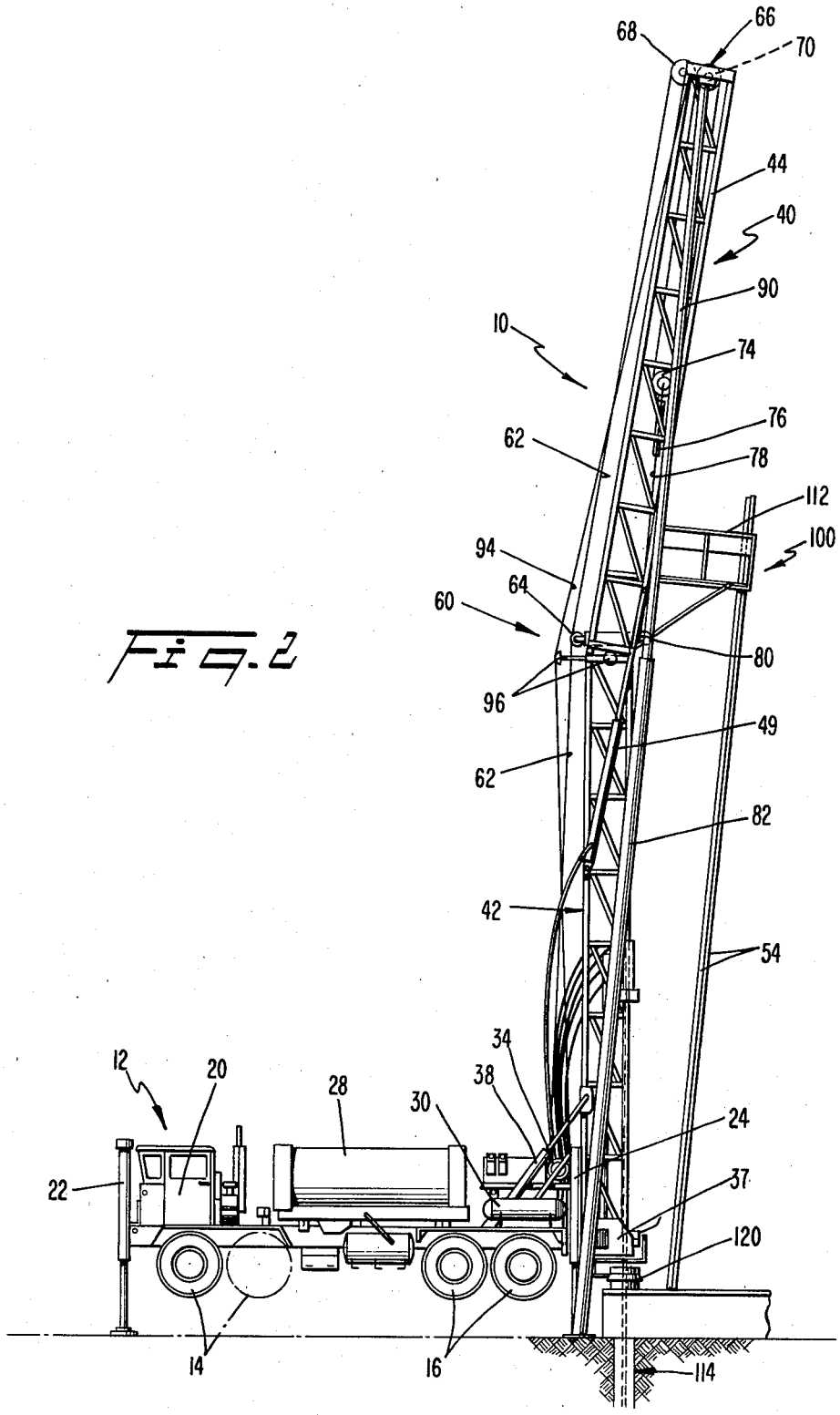
FIG. 2 is a side view of a rig with an erected mast structure, while the rig is in a drilling position.
Figure 3:
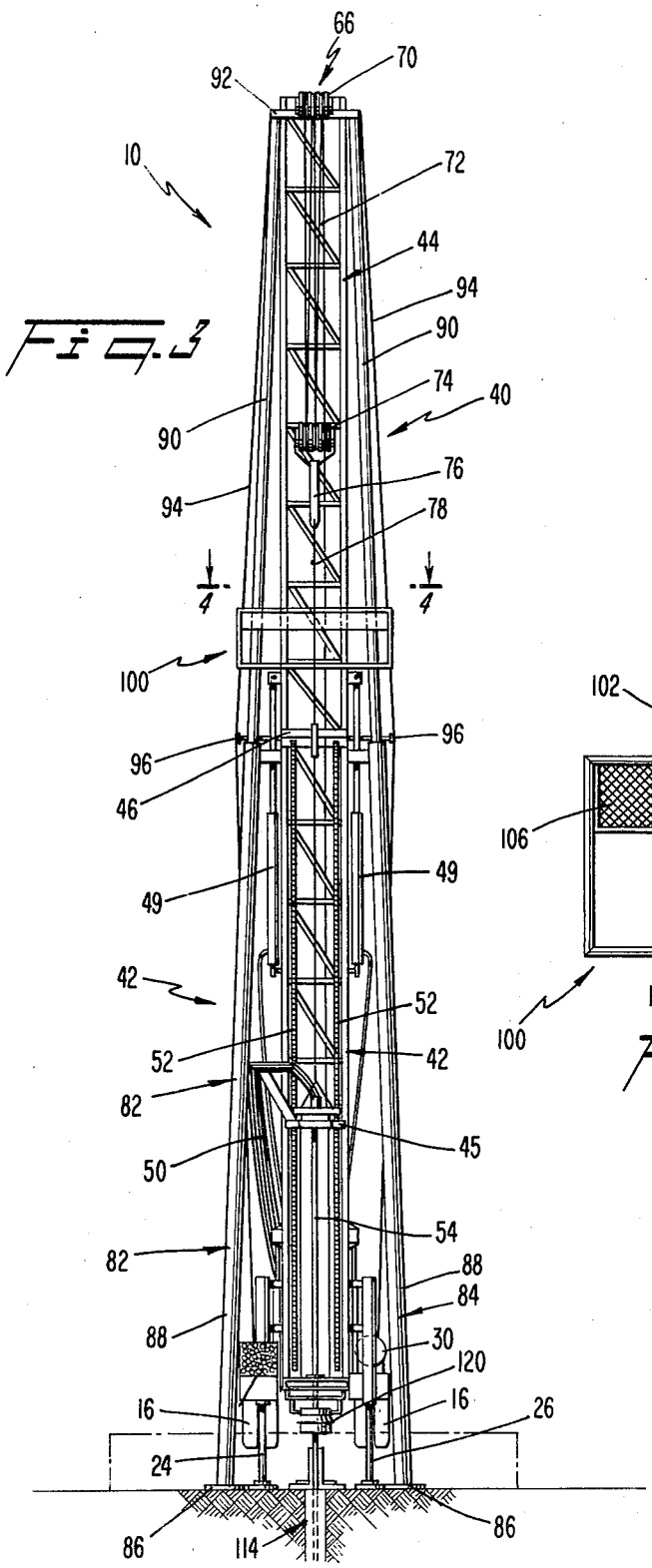
FIG. 3 is an end view of the rig in a drilling position.
Figure 5:
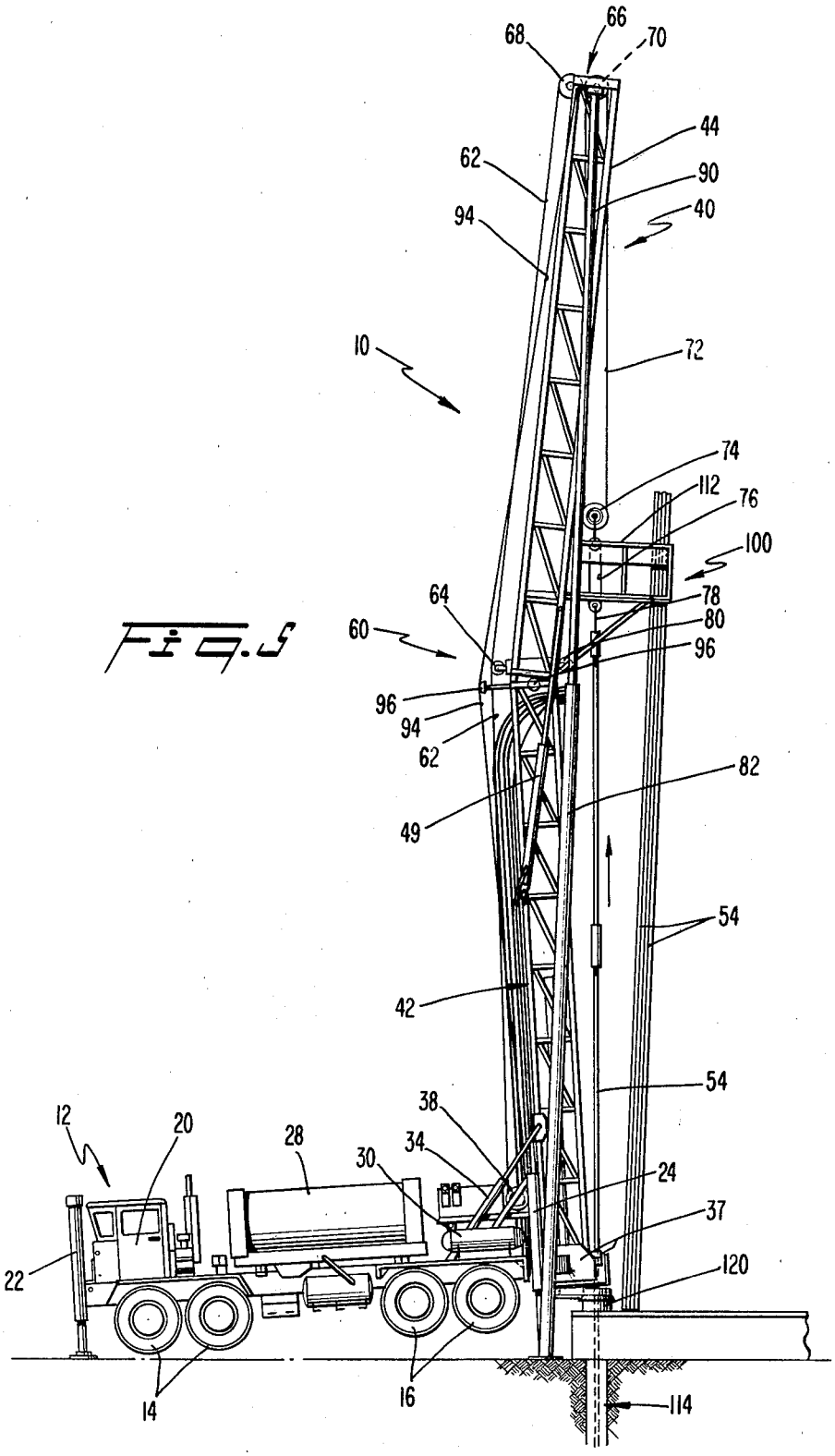
FIG. 5 is a side view of the rig in a drill pipe hoisting position.

Support structure 18 also carries a hydraulic cylinder 38 which lifts mast 40 from the folded position illustrated in FIG. 1 to an upright position, as illustrated in FIGS. 2, 3 and 5. Mast 40 includes a lower section 42 and an upper section 44, pinned together by rod 46, FIG. 3. Each of mast sections 42 and 44 is an elongated, box-like, trussed structure. While rig 10 is underway, moving from site to site, upper section 44 is folded on lower section 42, and both sections have parallel longitudinal axes, parallel to the longitudinal axis of support surface 18 of vehicle 12. To drill a vertical bore hole, lower section 42 is erected from the position illustrated in FIG. 1, to a position where the longitudinal axis of the lower section is perpendicular to the plane of support surface 18, by hydraulic cylinder 38, having one end pinned to support surface 18 and a second end pinned to a point on lower mast section 42, approximately one-quarter of the way up from the bottom of the lower segment. Upper mast segment 44 is raised by a hydraulic cylinder 49, having one end pinned to lower mast segment 42, approximately one-third of the way down from the top of the mast section, and a second end pinned to mast section 44, at a point approximately one eighth of the way up from the bottom of the upper mast section. In the erected condition of mast 40, the longitudinal axis of upper segment 44 is displaced relative to the longitudinal axis of lower segment 42 so that the upper segment extends rearwardly of the lower segment relative to vehicle 12. Suitable hydraulic cables interconnect cylinders 38 and 49 so the cylinders are hydraulically driven by a hydraulic pump in drive and compressor unit 28.

Lower mast section 42 carries a conventional power rotary drill head, i.e., power swivel, 48, FIG. 3. Power swivel 48 is rotatably driven with hydraulic fluid supplied through conduits 50 by the hydraulic pump drive and compressor unit 28. Power swivel 48 is vertically translatable from a lower position, in proximity to wheels 16, to an upper position, in proximity to shaft 46, by a pair of chains 52, mounted in parallel relationship with each other so they extend parallel to the longitudinal axis of mast section 42. Chains 52 pass over sprockets at the upper and lower ends of mast section 42 and are hydraulically driven, in a conventional manner, by the pump within drive and compressor unit 28 via hoses connected to hydraulic cylinders that drive the sprockets. As is well known to those skilled in the art, power swivel 48 includes an opening in which threads are located for selectively holding sections of drill pipe 54 fixedly in place. When a length of drill pipe has been drilled into the ground or retracted from a bore hole in the ground, the threads are open, permitting insertion and removal of drill pipe sections 54. As illustrated in FIGS. 2 and 3, power swivel 48 moves vertically along the face of mast segment 44 farthest away from the remainder of vehicle 12.

To assist in hoisting power swivel 48 and to enable a relatively long drill string, such as 5,000 feet, to be powered by power swivel 48 (as cannot be done with the prior art which only includes the chain drive for the vertical movement of the power swivel), the power swivel is connected to a cable means 60 which is driven from draw works 34. Cable means 60 includes a first cable section 62, one end of which is paid around the cylinder of draw works 34 and across sheave 64, pivotably mounted on a shaft fixed to mast segment 42 at the intersection between lower and upper mast segments 42 and 44. From sheave 64, cable 62 is paid around crown block 66, at the upper end of upper mast segment 44. Crown block 66 includes main pulley 68 and plural auxiliary pulleys 70, with cable 62 being wound about pulley 68. Below pulleys 70 is travelling block 74 that includes the same number of pulleys 75 as there are auxiliary pulleys in crown block 66. Cable 62 is paid between pulleys 70 and 75 to form a multi-stranded line between crown block 66 and travelling block 74. From the end pulley in crown block 66 cable 62 returns to vehicle 12, to which it is fixedly secured. Typically, there are 4, 6 or 8 strands in cable 72.

One end of weight connector 76 is pivotably suspended by a hook (not shown) from travelling block 74, with the other end of the weight connector being connected to cable 78 by a suitable hook (not shown). Cable 78 is paid across sheave 80, rotatably mounted on a fixed shaft to mast segment 44 at the intersection of mast segments 42 and 44, on the rear face of the mast, i.e., the face remote from the rear of vehicle 12. From sheave 80, cable 78 extends in tension to and is connected to an upper face of power swivel 48 to support the power swivel. To raise and lower power swivel 48 during deep bore hole drilling, chains 52 and cable means 60, including cables 62, crown block 66, multi-stranded cable 72, travelling block 74, weight connector 76 and cable 78, are simultaneously activated to raise and lower power swivel 48. By utilizing both chain 52 and cable means 60, it is possible to increase considerably the weight which power swivel 48 can hold, and thereby increase the drilling depth of the drill string including drill pipe section 54.

Figure 4:
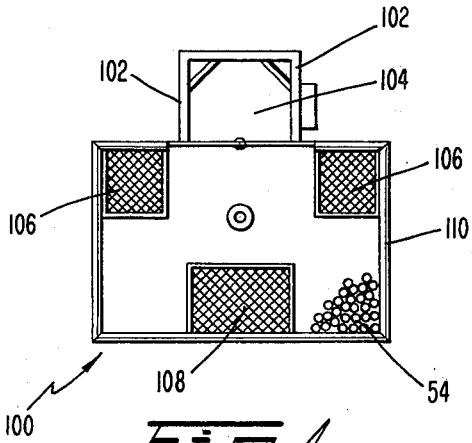
FIG. 4 is top view of a platform of the rig.

During a drilling operation, wheels 14 and 16 of vehicle 12 are lifted off of the ground, and rig 12 is supported by jacks 22, 24 and 26, as illustrated in FIGS. 2–4. Additional support for mast 40 is provided by telescoping, adjustable length, rigid legs 82 and 84, which are fixedly connected between the ground adjacent rear outrigger jacks 24 and 26 and the upper end of upper mast section 44. Each of telescoping legs 82 and 84 includes a foot 86, having a relatively large surface area, and which can be threaded into the lower end of telescoping legs 82 and 84, to provide adjustable length for the legs. To provide maximum stability, feet 86 of legs 82 and 84 are aligned with feet of jacks 24 and 26, so that all of the feet are in a straight line. Telescoping of legs 82 and 84 is provided by forming each leg of two segments, whereby each of legs 82 and 84 includes a lower section 88 having a larger diameter than an upper section 90. The upper end of upper section 90 is fixedly mounted to horizontally extending strut 92, fixedly mounted to the top of upper mast segment 44, by being threaded into a stub cylinder (not shown) extending downwardly from the strut.

Further stability for erected mast 40 is attained by cables 94, each of which extends from draw works 34 to a pin on strut 92, at the top of upper mast segment 44. Each of cables 94 is paid around a sheave 96 that is rotatably mounted on a shaft 98 which extends horizontally from mast segment 44, at the intersection between upper and lower mast segments 42 and 44, so that sheaves 96 are outside of telescoping legs 82 and 84. The upper end of each of cables 94 is fixedly connected to strut 92, at a position between pulleys 68 and 70 of crown block 66 to provide maximum stability.

Upper mast segment 44 includes a foldable drill pipe casing platform 100, a top view of which is illustrated in FIG. 4. Platform 100 is rotatably mounted on the back face of upper mast segment 44 remote from vehicle 12, and is rotatably pinned to upper mast segment 44 approximately ⅛ of the way up from the intersection between the upper and lower mast segments. Platform 100 is connected to the side of upper mast section 44 by beams 102, between which space 104 is provided through which cables 78 may pass. Platform 100 includes two corner floor portions 106, and a central floor portion 108, where operators stand to rack pipe sections 54 which extend through a space between the floor sections, which are held in situ by frame 110 to which floor sections 106 and 108, as well as beams 102, are connected. Platform 100 includes hand rails 112 which can be removed to enable the platform to be folded against mast segment 44, thereby enabling the mast segment to be folded down onto the top of lower mast segment 42, in the position illustrated in FIG. 1.

When mast 40 is erected, the longitudinal axes of lower and upper segments 42 and 44 are displaced from each other by an amount sufficient to assure that pulley 70 is behind all portions of lower mast section 42 and any portions of vehicle 12 which extend beyond mast section 42. Typically, the displacement angle between the longitudinal axes of upper and lower mast sections 42 and 44 is approximately 10° to 15°. The angular relation is such that two or three sections of drill pipe can be pulled past rotary drill head 48, enabling two or three lengths of drill pipe (typically each drill pipe length is 20 feet long) to be stored in the elongated, two sectioned mast. By angling upper section 44 rearwardly of lower section 42, relative to vehicle 12, necessary clearance for hoisting and lowering drill pipe sections is provided. In the drilling position, the drilling center line of lower section 42 is vertically aligned over hole 114 through which drill pipe sections 54 extend. When drilling is stopped, and it is desired to pull each drill pipe section 54 from hole 114, crown block pulley 70, at the top of upper mast segment 44 is aligned with hole 114 and rotary swivel 48 is disconnected from the drill pipe string. The drill pipe string is then raised to the top of upper section 44, and the drill pipe is racked into the space between floor segments 106 and 108 of platform 100. During drilling, support surface 18 is maintained parallel to the ground, by jacking the front and rear ends of vehicle 12 to the same height, by means of front and rear jacks 22, 24 and 26. For vertical hole drilling, lower mast segment 42 is maintained perpendicular to support surface 18, as illustrated in FIG. 2.

To lift a drill string from a vertical hole, the rear end of vehicle 12 is lifted relative to the front end, by suitably lowering front jack 22 relative to rear jacks 24 and 26, while maintaining the longitudinal axis of lower mast segment 42 perpendicular to support surface 18, as illustrated in FIG. 3. The front jack 22, is activated so that pulley 70, in crown block 66, is aligned with hole 114 in the ground. The drill string is released from rotary drill head 48 to enable the aligned condition between pulley 70 and hole 114 to be easily maintained and enable the elongated drill string to be lifted from the hole in the ground, by utilizing chains 52 and pulley means 60.

If it is desired to drill holes which are not vertical, it is merely necessary to orient lower mast segment 42 at an angle that is not perpendicular to support surface 18 so that the lower mast segment is angled toward the front of vehicle 12, without changing the angle between the longitudinal axes of segments 42 and 44. During non-vertical drilling, lower mast section 42 is maintained in alignment with the drill hole and support surface 18 is maintained parallel to the ground. To raise the drill string after non-vertical drilling, the front end of vehicle 12 is lowered and pulley 77 of crown block 66 is aligned with the hole which has been drilled.

In operation, vehicle 12 is driven to a site with mast 40 folded so that segment 42 bears against a portion of the frame of vehicle 12, and segment 44 is folded onto segment 42, as illustrated in FIG. 1. When vehicle 12 arrives at the site, the site is prepared by positioning slip 120 over the desired place where bore hole 114 is to be drilled. Mast 40 is then erected to the position illustrated in FIG. 2 by supplying hydraulic pressure to cylinder 38, to drive mast 40 off of vehicle 12. For vertical bore holes, as illustrated in FIG. 2 by bore hole 114, mast 40 is erected so that lower segment 42 is at right angles to support surface 18. Vehicle 12 is then backed into position over slip 120 so that the opening in power swivel 48 is aligned with the center of slip 120 and the center of the bore hole 114 to be drilled. Then, vehicle 12 is lifted by jacks 22, 24 and 26 to the position illustrated in FIG. 2 so that support surface 18 is parallel to the ground beneath vehicle 12 and the site of the bore hole 114 to be drilled. With vehicle 12 in the stabilized position illustrated in FIG. 2, upper mast segment 44 is erected by supplying hydraulic fluid to piston 44, whereby upper segment 44 extends upwardly and rearwardly from lower segment 42, at an angle from the vertical of 10° to 15°. Then platform 100 is folded away from upper segment 44, to the position illustrated in FIG. 2.

With mast 40 erected, legs 82 and 84 are removed from a tray (not shown) on vehicle 12 by separately connecting each of the legs to the free end of cable 78, which extends over sheave 80 and is lowered to the ground by activation of draw works 34. Then, leg 82 or leg 84 is removed by cable means 60 and draw works 34 from the tray, with the cable means connected to a midpoint of the leg which is to be connected to strut 92. Inner section 90 is pulled from outer section 88 of the leg by draw works 34 and cable means 60 and a fixed connection between the two sections is established by driving a pin (not shown) through aligned transverse bores at the top of section 88 and the bottom of section 90. The leg is then erected, approximately to the position illustrated in FIG. 2, by draw works 34 and cable means 60 so that the top end of segment 90 is inserted into a stub cylinder (not shown) downwardly depending from strut 92. An operator drives a pin (not shown) through aligned radially extending bores in the downwardly depending stub cylinder and the upper end of segment 90. Lower segment 88 is then fixed in place by positioning foot 86 so that it is in a straight line relationship with the feet of outrigger jacks 24 and 26. Vertical adjustment for foot 86 is attained by turning the foot in threads at the bottom of leg segment 88. After one of legs 82 and 84 has been erected in the stated manner, the other leg is similarly erected. Both legs 82 and 84 are erected so that there is a straight line relationship between feet 86 at the bottom of both legs and the feet on outrigger jacks 24 and 26, to maximize stability.

After legs 82 and 84 have been erected, drill pipe segments 54 are withdrawn from the tray (not shown) on vehicle 12. Segments 54 are put in position so that they are vertically supported on the ground and by frame 110 of platform 100. To this end, an end of drill pipe 54 in the tray is connected to the end of cable 78 which extends over sheave 90 and has been dropped to the ground by activation of draw works 34. With cable 78 so connected to each drill pipe 54, draw works 34 is activated and the pieces of drill pipe are brought to a vertical position so that they extend through platform 100, between floor spaces 106 and 108 and rest against frame 110.

After drill pipes 54 have been placed in situ between the ground and platform 100, power hoist 48 is driven to the top of lower mast segment 42 by chains 52. With a drill bit attached to the lower end of a first drill pipe 54, the first drill pipe is placed in situ within power swivel 48. Then, power swivel 48 is activated to drive the first drill pipe downwardly through slip 120, to bore the first segment of bore hole 114. After the first segment of bore hole 114 is drilled, the first drill pipe is released from power swivel 48 and the power swivel is raised by chain 52 to the top of mast segment 42. Cable 78 is then employed to transfer a second drill pipe 54 to power swivel 48. The lower end of the second drill pipe is screwed into the upper end of the first drill pipe which is in bore hole 114. Then, power swivel 48 is activated to drive the second drill pipe into the earth. The process continues in this manner until difficulty in drilling pipes 54 into the earth occurs.

When difficulty in drilling pipes 54 into the earth is encountered, the end of cable 78 is attached to the upper end of power swivel 48 after a drill pipe has been inserted into the power swivel, as illustrated in FIGS. 2 and 4. Then, draw works 34 is activated simultaneously with chains 52 to drive power swivel 48 and the relatively long drill string into bore 114. By adding the power of draw works 34 to the driving power of the drive for chains 52, it is possible to increase the hoisting capability of a prior art rig from 44,000 pounds to approximately 150,000 pounds.

After hole 114 has been drilled, as described supra, and it is desired to remove the relatively long drill string from the hole, the front end of vehicle 12 is lowered relative to the rear end by lowering jack 22, so that pulley 70 is aligned with bore hole 114, and cable 78 is removed from sheave 80 and power swivel 48, as illustrated in FIG. 5. In the position illustrated in FIG. 5, the lower end of cable 78 is connected to the upper end of the topmost drill pipe of the drill string. Feet 86 of legs 82 and 84 remain substantially aligned with the feet of outrigger jacks 24 and 26. The outrigger jacks include flexible couplings (not shown) enabling tilting of vehicle 12, without causing turning of the feet of jacks 22, 24 and 26, when vehicle 12 is in the position illustrated in FIG. 3.

After a hook at the end of cable 76 has been attached to the topmost pipe of the drill pipe string, draw works 34 is activated to raise drill pipe sections from hole 114. To this end, cable 78 extends through a space inside of frame 110, between floor segments 106 and 108 of platform 100. As each drill pipe is withdrawn from bore hole 114 and removed from the remainder of the drill string, the remainder of the drill string is held in situ by slip 120. The individual drill pipes removed from the remainder of the drill string which stays in bore hole 114 is hoisted by driving draw works 34, so that cable 78 is lifted toward crown block 66. The procedure is continued in this manner until the entire drill string has been removed from bore hole 114.

After removal of the entire drill string from bore hole 114, drill pipes 54 are returned to the rack on vehicle 112. Then legs 82 and 84 are removed from strut 92, retracted and returned to the rack. Platform 100 is then folded onto mast segment 44, and mast segment 44 is folded onto mast segment 42. Thereafter, mast 40 is folded onto vehicle 12 and wheels 16 and 18 are returned to the earth by lowering jacks 22, 24 and 26. Vehicle 12 is then ready to be driven to another site.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A drilling rig adapted to be carried by a vehicle normally having a horizontal flat surface comprising a mast having upper and lower sections, each having a longitudinal axis, the lower section being mounted on the surface, the upper section being secured to the lower section so the longitudinal axes of the upper and lower sections are offset at a predetermined acute angle, a rotary power drill head translatable along the length of the lower section, the power drill head including an aperture in which drill pipe is secured, a drawworks on the vehicle, cable means extending from the drawworks over pulley means at the top of the upper section and thence downwardly, means for controlling the angle of the surface so that during drilling the surface is horizontal and the aperture is aligned with a drill hole through which drilling pipe extends and during pipe hoisting the pulley means is aligned with the hole so a portion of the cable means extends from the pulley means in line with the hole, the cable means portion being attached to the pipe during hoisting, a sheave at the intersection of the two sections, said sheave being positioned and the axes being offset so said portion of the cable means can be paid over said sheave and extend in tension to support said drill head during drilling and said portion of the cable means can be removed from said sheave during hoisting.

2. A drilling rig as claimed in claim 1 further including first and second rigid, adjustable length support legs extending from adjacent the top of the upper section to bear against a support surface for the vehicle beyond opposite sides of the mast.

3. A drilling rig as claimed in claim 2 wherein the angle controlling means includes a pair of vertical outrigger supports extending from the flat surface to bear against the ground, said outrigger supports and support legs intersecting the ground on a common straight line, the support legs intersecting the ground outside of the outrigger supports.

4. A drilling rig as claimed in claim 3 wherein said outrigger supports and support legs intersect the ground on a common straight line.

5. A drilling rig adapted to be carried by a vehicle normally having a horizontal flat surface comprising a mast having upper and lower sections, each having a longitudinal axis, the lower section being mounted on the surface, the upper section being secured to the lower section so the longitudinal axes of the upper and lower sections are offset at a predetermined acute angle, a rotary power drill head translatable along the length of the lower section, the power drill head including an aperture in which drill pipe is secured, a drawworks on the vehicle, cable means extending from the drawworks over pulley means at the top of the upper section and thence downwardly, means for controlling the angle of the surface so that during drilling the surface is horizontal and the aperture is aligned with a drill hole through which drilling pipe extends and during pipe hoisting the pulley means is aligned with the hole so a portion of the cable means extends from the pulley means in line with the hole, the cable means portion being attached to the pipe during hoisting, first and second rigid, adjustable length support legs extending from adjacent the top of the upper section to bear against a support surface for the vehicle beyond opposite sides of the mast, the angle controlling means including a pair of vertical outrigger supports extending from the flat surface to bear against the ground, said outrigger supports and support legs intersecting the ground on a common straight line, the support legs intersecting the ground outside of the outrigger supports.

6. A drilling rig as claimed in claim 5 wherein said outrigger supports and support legs intersect the ground on a common straight line.

7. A drilling rig as claimed in claim 1 wherein the upper section is foldable on top of the lower section, and retractable strut means connecting the upper and lower sections together for raising and lowering the upper section relative to the lower section between a folded position to a position wherein the axes are at the predetermined angle, said strut means maintaining the predetermined angle during drilling and hoisting.

8. A drilling rig as claimed in claim 1 wherein the pulley means comprises a crown block.

9. A drilling rig as claimed in claim 1 wherein the cable means portion includes a travelling block and a weight connector.

10. A method of drilling into the earth with a rig having a mast with a lower section that extends from a support surface therefor and an upper section having a longitudinal axis offset from that of the lower section, said rig including a rotary power drill head translatable along the length of the lower section and a drawworks including a cable extending over a pulley at the top section, comprising boring a hole in the ground by rotatably driving the drill head with a drill pipe therein, said hole having an axis aligned with the longitudinal axis of the lower section, maintaining the support surface parallel to the earth while (a) the drill head is supported by a portion of the cable downwardly depending from the pulley and (b) tension is applied thereto by the drawworks, and hoisting the drill pipe by tilting the support surface so the cable axis, as the cable is paid around the pulley, is aligned with the drill hole while (a) the downwardly depending portion is connected to the pipe, (b) the drawworks applies tension to the cable and thence the pipe and (c) the pipe is displaced from the drill head.

11. The method of claim 9 wherein the lower section includes a motive means for raising and lowering the head along the lower section, and further comprising raising and lowering the head along the lower section for deep bore hole drilling by simultaneously driving the motive means and the cable with the drawworks while the cable is attached to the head.

12. A drilling rig adapted to be carried by a vehicle normally having a horizontal flat surface comprising a mast having upper and lower sections, each having a longitudinal axis, the lower section being mounted on the surface, the upper section being secured to the lower section so the longitudinal axes of the upper and lower sections are offset at a predetermined acute angle, a rotary power drill head translatable along the length of the lower section, the power drill head including an aperture in which drill pipe is secured, a drawworks on the vehicle, cable means extending from the drawworks over pulley means at the top of the upper section and thence downwardly, means for controlling the angle of the surface so that during drilling the surface is at a first predetermined angle at right angles to the hole being drilled and the aperture is aligned with a drill hole through which drilling pipe extends and during pipe hoisting the surface is at a second predetermined angle at which the pulley means is aligned with the hole so a portion of the cable means extends from the pulley means in line with the hole, the cable means portion being attached to the pipe during hoisting, a sheave at the intersection of the two sections, said sheave being positioned and the axes being offset so said portion of the cable means can be paid over said sheave and extend in tension to support said drill head during drilling and said portion of the cable means can be removed from said sheave during hoisting.

13. The method of driling into the earth with a rig having a mast with a lower section that extends from a support surface therefor and an upper section having a longitudinal axis offset from that of the lower section, said rig including a rotary power drill head translatable along the length of the lower section and a drawworks including a cable extending over a pulley at the top section, comprising boring a hole in the ground by rotatably driving the drill head with a drill pipe therein, said hole having an axis aligned with the longitudinal axis of the lower section, maintaining the support surface at a first predetermined angle at right angles to the hole being bored while (a) the drill head is supported by a portion of the cable downwardly depending from the pulley and (b) tension is applied thereto by the drawworks, and hoisting the drill pipe by tilting the support surface to a second predetermined angle so the cable axis, as the cable is paid around the pulley, is aligned with the drill hole while (a) the downwardly depending portion is connected to the pipe, (b) the drawworks applies tension to the cable and thence the pipe and (c) the pipe is displaced from the drill head.

* * * * *